US005843323A

United States Patent [19]

Ranard

[11] Patent Number: 5,843,323

[45] Date of Patent: Dec. 1, 1998

[54] ADJUSTABLE WINDOW POUR MOLD MOUNTING SYSTEM

[75] Inventor: Larry Joseph Ranard, Woodward, Iowa

[73] Assignee: M&G Manufacturing Company Incorporated, Waukee, Iowa

[21] Appl. No.: 767,605

[22] Filed: Dec. 17, 1996

[51] Int. Cl.[6] ..... E04G 15/02

[52] U.S. Cl. ..... 249/39; 249/40

[58] Field of Search ..... 249/35, 39, 40

[56] References Cited

U.S. PATENT DOCUMENTS

| | | | |
|---|---|---|---|
| 821,277 | 5/1906 | Bellars | 249/16 |
| 2,557,631 | 6/1951 | Callan | 25/128 |
| 2,602,983 | 7/1952 | Troiel | 25/131 |
| 2,787,820 | 4/1957 | Sheilds et al. | 25/131 |
| 2,893,235 | 7/1959 | Goldberg | 72/98 |
| 2,901,810 | 9/1959 | Richards | 25/131 |
| 3,092,887 | 6/1963 | Switzer | 25/131 |
| 3,367,618 | 2/1968 | Masur | 249/39 |
| 4,854,543 | 8/1989 | Daigle et al. | 249/95 |
| 5,169,544 | 12/1992 | Stanfill et al. | 249/22 |
| 5,458,828 | 10/1995 | Chuang | 264/35 |

FOREIGN PATENT DOCUMENTS

| | | |
|---|---|---|
| 210617 | 8/1960 | Germany . |

*Primary Examiner*—David W. Wu
*Attorney, Agent, or Firm*—Robert A. Seemann

[57] ABSTRACT

A window pour mold mounting system in which a window pour mold buck or window frame form in the wall mold is mounted at any one of a plurality of different heights using the same customarily available wall mold panel connector hole, and a tie guide on one location on the window pour mold.

6 Claims, 10 Drawing Sheets

ADJUSTABLE WINDOW POUR MOLD MOUNTING SYSTEM

BACKGROUND OF THE INVENTION

1. Field of the Invention

This invention pertains to mounting of a pouring form transverse to a planar wall mold in building construction to form a window opening through the building wall, more specifically to a window pour mold positioning system for mounting a pouring buck, a window frame form, or both, at one of a plurality of heights within a metal mold for the wall, to an existing attachment point on the metal mold.

2. Description of the Prior Art

U.S. Pat. No. 2,602,983 patented Jul. 15, 1952 by A. E. Troiel describes a wall form comprising a plurality of sheet steel panels having their top and bottom edges each bent to an L-shaped flange. In setting up the form, the lowermost panels are placed in position in spaced relationship determined by the thickness of the wall to be cast.

Tie members are laid across the tops of the panels and a second row of panels are set upon the tie members. Each tie member consists of a strap-shaped piece of metal having perforations therein for alignment with perforations in the channels of the panels' L shaped flanges so that a bent nail or pin may be inserted to prevent movement of the tie members with respect to the panels. The tie members resist spreading apart of the spaced panels by the bursting force of freshly poured concrete. A window frame form is mounted between the spaced panels so that it excludes poured concrete from what becomes the window opening through the wall. The window frame form sill rests on the top of a panel and tie, and is anchored to the wall form by a hook that engages the window frame form and extends through a slot in the tie external to and adjacent to the wall form. The hook is lodged tightly in the slot by a wedge that is driven into the slot.

Above the anchor at the low end of the window frame form, wall form panels overlap the vertical sides of the window frame form. In order to anchor the window frame form to these overlapping wall form panels, horizontally projecting plates are welded to the window frame form. The plates coincide in elevation with the seams between the vertically-positioned wall form panels and are adapted to fit between the panels. The plates are perforated such that selected perforations can coincide with those in the panel channels, and by passing a large nail or pin through such aligned openings, anchoring of the window frame form to these wall for panels is obtained.

In a widely used prior art design for mounting a window pour mold, referring to FIGS. 1 and 2, mold wall 24 is one of two walls 24 and 54 which are used to form concrete vertical wall 26 that contains opening 28 through the wall for a window. Wall 24 includes panels 30, 32, and 34.

Buck 20 forms the outer threshold for the window opening by excluding poured concrete from the volume defined by sides 40, 42, 44, and 46 of sections 36 and 38 of the buck.

FIG. 2 shows a window frame form 50 mounted on buck 20. The frame/buck assembly comprises the window pour mold. The window pour mold is sandwiched between wall mold wall 24 and mold wall 54, and forms opening 28 through the wall. A window pour mold may be a window frame form alone, a buck alone or a window frame form and buck. A buck with window frame form recesses the window frame in the wall opening. A buck can be made deep enough to form a wall opening in which a window frame is installed after the concrete sets.

Ridges 56, 58, 60, and 62 lock frame form 50 in the concrete once the concrete sets. After the concrete sets, walls 54 and 24 are removed, and section 36 is slid out from frame 50, leaving opening 28 through wall 26.

Panels 30, 32, and 34 are connected together by vertical L-shaped panel connector flanges 70, 72, 74, and 76. The flanges are held in alignment by pins 78 through holes 80 which are designed to withstand shear forces applied by the concrete poured between walls 54 and 24.

The frame/buck assembly is mounted between walls 54 and 24 at a height that is set by tie 86 attachment to one of holes 80 which are spaced apart according to industry standards for aluminum forming systems 6-12, 8-8, or 8-24 for concrete walls. The spacing between holes 80 vary in increments of 6", 8", 12", and 24", for systems 6-12, 8-8, or 8-24.

In FIG. 1 the tie is attached to the frame/buck assembly by passage of the tie through slot 92 of tie guide 94. Tie guide 94 is clamped on buck sides reinforcement brace 98 by threaded bolts and nuts 90 which pass around brace 98 and which pass through support plate 96. Nuts and bolts 90 are used to clamp guide 94 at a desired height on brace 98. The outer side of a support plate 96 is shown on brace 100.

Tie guide 94 is mounted loosely on brace 98 by bolts and nuts 90 which straddle the brace, and slid to a desired height and then clamped on the brace at that height by tightening nuts and bolts 90. Since the height and width location of panel connector holes 80 is predetermined by the assembly of walls 54/24, in manufacturing the buck the height 112 of tie guide 94 on brace 98 is calculated to take into account the anticipated location of a suitable panel connector hole 80 in the construction of the wall form walls 54/24 assembly, or the tie guide is custom-installed on the brace at the work site.

SUMMARY OF THE INVENTION

When concrete wall and window pour mold systems were wooden, positioning of the window pour mold's window frame form or window frame form and buck has been simple, inexpensive, and provided a plurality of mounting positions on the wall mold by just nailing the window frame form or the buck to one of the wall mold walls.

With the advent of reusable aluminum or other metal mold walls, and a reusable buck, attachment of the window pour mold to a wall mold wall has been limited to attaching a tie to one of the customarily available predetermined panel connector flange panel connector holes. Drilling additional holes in the wall mold wall or in the buck or in the window frame form to adapt it for a particular window pour mold height is undesirable because it weakens the aluminum element being drilled, takes extra labor and time at the job site. A corrected hole made too close to a mislocated hole can start a crack in an aluminum or metal element. Old unused holes are a site for concrete leakage during the pour.

The present invention supports a window frame form or pouring buck so that it may be cast in a concrete wall at any one of a plurality of heights which are independent of the height location of existing attachment holes in the aluminum forms of the concrete wall forming system.

It is one object of the invention to provide a window pour mold mounting system in which the position of a window pour mold, buck or window frame form in the wall mold is independent of an attachment point of a tie to a wall mold wall.

It is another object of the invention that the window pour mold can be mounted on the wall mold at any one of a plurality of different heights using the same wall mold panel connector hole.

It is another object of the invention that the mounting system is reusable for a different wall mold without changing, moving, or modifying the window pour mold tie guide.

It is another object that the mounting system can be used to mount a window pour mold at a different height using the same wall mold panel connector hole without changing or modifying, a tie guide element of the window pour mold.

It is another object that the mounting system can be used to mount a window pour mold at a different height using the same wall mold panel connector hole without making an additional hole in the window pour mold.

It is another object that the mounting system can be used to mount a window pour mold at a different height using the same wall mold panel connector hole without modification of a surface of the window pour mold, for example by drilling or welding, to relocate a strip guide on the window pour mold.

It is another object that the mounting system can be used to mount a window pour mold buck or window frame form in the wall mold at any one of a plurality of different heights using the same customarily available wall mold panel connector hole, and the same tie guide on the widow pour mold.

Other objects and advantages will become apparent to a reader from the ensuing description of the invention.

A tie guide mounted on a window pour mold frame has a plurality of openings through the tie guide. Each of the plurality of openings is shaped to receive a tie through the tie guide for supporting the window pour mold by the tie at a height that is different from the height at which an adjacent one of the plurality of openings supports the window pour mold by the tie.

The difference in height of support by a first and a second of the plurality of openings may include the distance apart of the first and second of the plurality of openings.

The tie guide may be mounted movably on the frame for moving from a first location on the frame to a second location on the frame so that a tie through the tie guide supports the window pour mold at any height between a height supported with the tie guide at the first location and with the tie guide at the second location.

A window pour mold positioning system includes a wall mold, a first customarily available attachment point on the wall mold for a tie, a tie attached to the first customarily available attachment point, a window pour mold having a frame and a length, and a tie guide mounted on the frame and adapted for adjustably receiving the tie at a plurality of locations along the length.

A second customarily available attachment point on the wall mold for a tie is adjacent to, and a first distance from, the first customarily available attachment point. Two of the plurality of locations along the length are closer to each other than the first distance.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
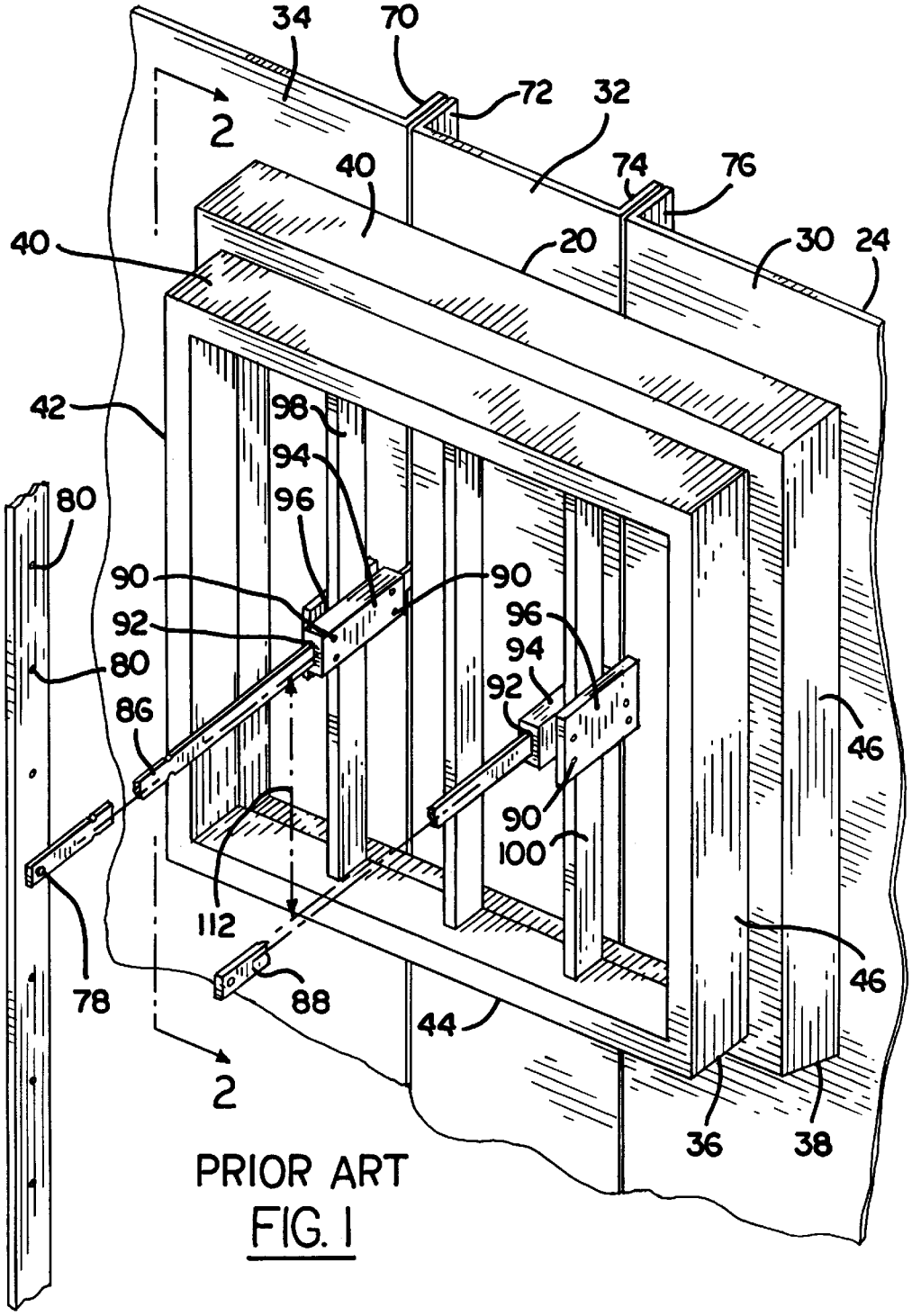
PRIOR ART FIG. 1
FIG. 1 is a perspective schematic view of a prior art window pour mold mounting system.
Figure 2:
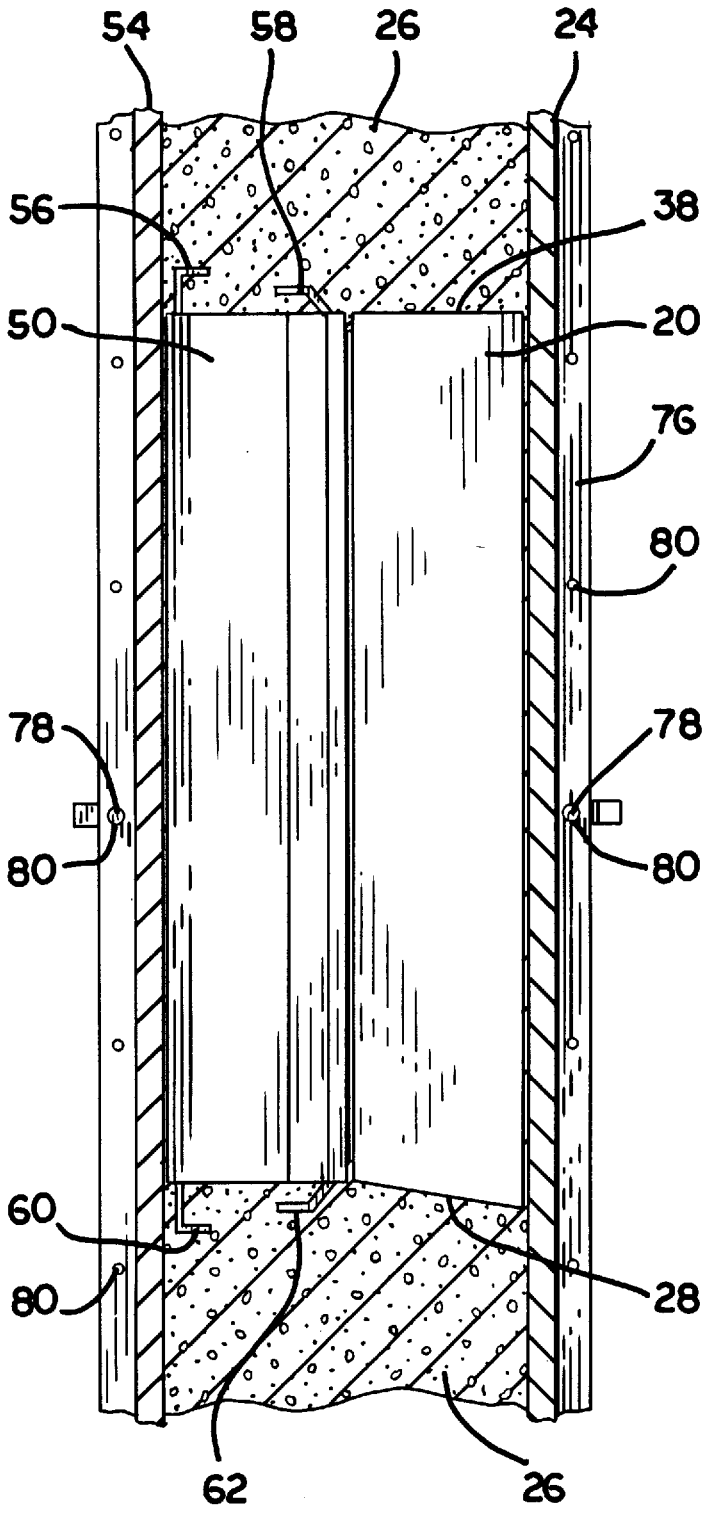
PRIOR ART FIG. 2
FIG. 2 is a right side view of a window pour mold mounting system. The elements visible in FIG. 2 are from FIG. 1.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 3:
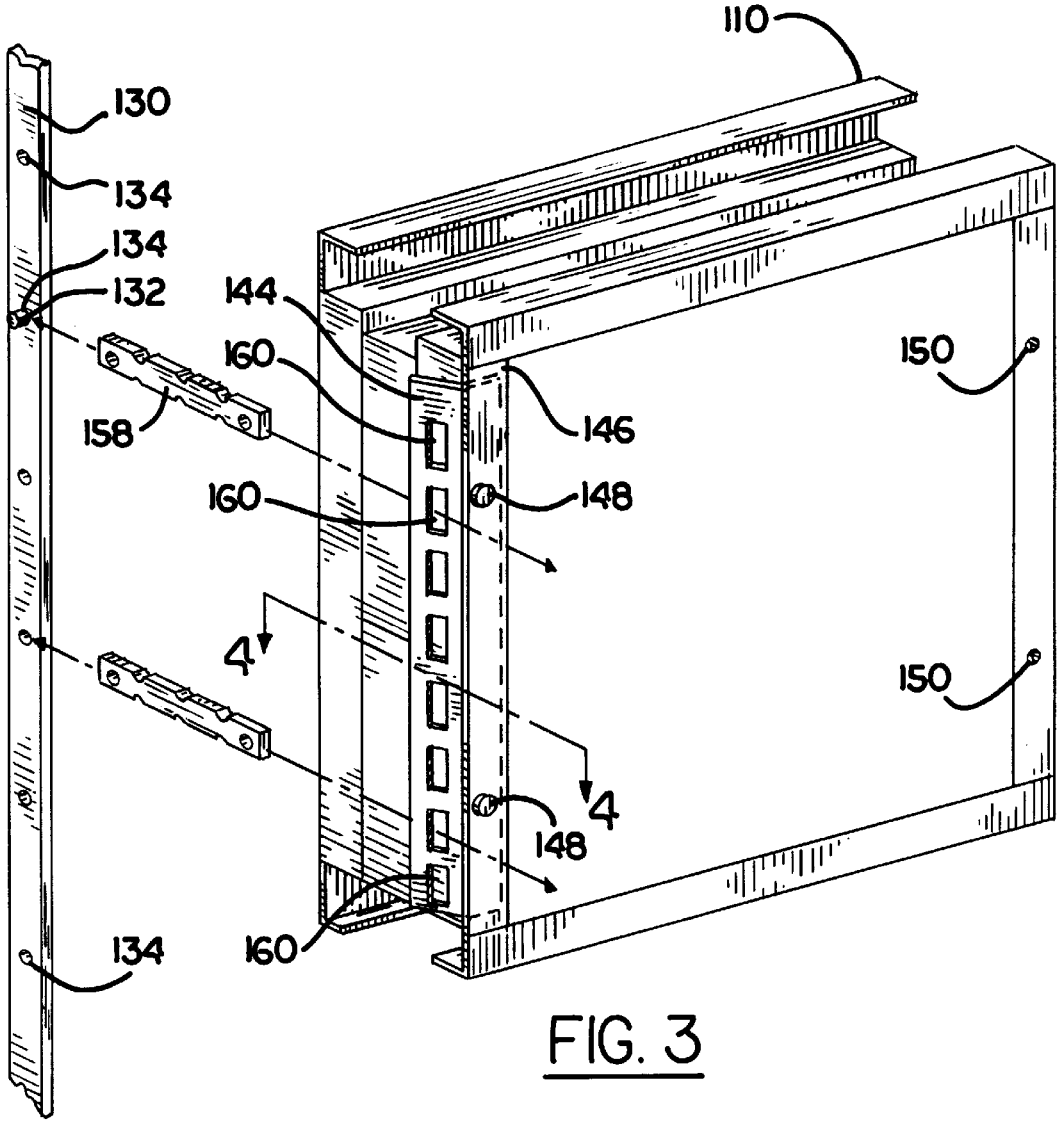
FIG. 3 is a perspective schematic view of a bucco window frame form mounted to a wall mold panel connector flange according to one embodiment of the invention.
Figure 4:
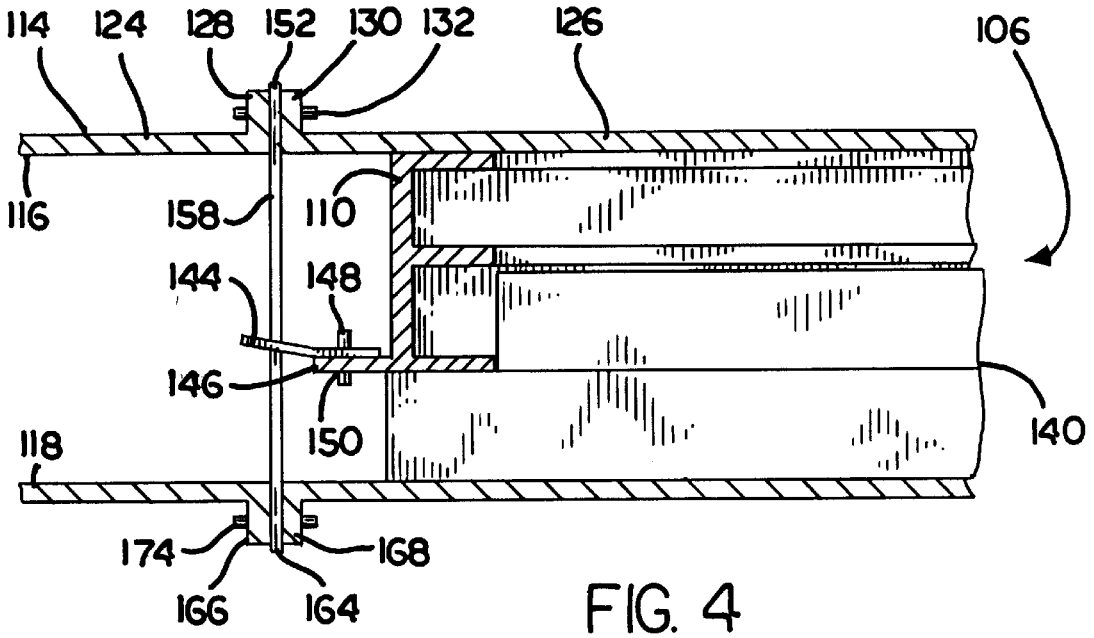
FIG. 4 is a top, schematic view of the bucco frame of FIG. 3 with a buck, mounted to wall mold walls.

Referring to FIGS. 3 and 4, window pour mold 106 which includes window frame form 110 and buck 140 is mounted between wall mold 114 walls 116 and 118. Mold wall 116 comprises panels 124 and 126 aligned to each other by panel connector flanges 128 and 130 and fastener pin 132 in panel connector hole 134. Other fastener means used in hole 134 may include a nut and bolt through the connector flanges.

Window frame form frame 110 has variable tie guide bracket 144 mounted on flange 146 by fasteners 148 in holes 150. Holes 150 are existing fastener means usually provided in window frames to hold a window well which is sometimes attached to the concrete wall, however, special holes for mounting the variable tie guide bracket can be made.

Tie 158 is a metal strap, but may be a metal, composite, or reinforced plastic strap, cord or rod. End 152 of tie 158 extends between panel connector flanges 128 and 130 and is pinned therebetween by fastener pin 132. Tie 158 extends through one of a plurality of slots 160 in variable tie guide bracket 144. It should be understood that the slot opening is shaped to receive the tie therethrough. The term "slot", therefore, means a suitably shaped opening for a tie, and may be round or otherwise shaped to accommodate a tie.

End 164 of the tie extends between panel connector flanges 166 and 168 of wall 118, and is pinned therebetween by fastener pin 174.

The configuration of the variable tie guide bracket may be adapted to accept the tie easily through one of the plurality of slots by making the slot opening normal to the path of the tie. The spacing pattern between slots 160 is different than the spacing pattern between existing panel connector holes 134, providing a greater variety of incremental height settings for mounting form 110 than are available from holes 134 which come with panel connector flange 130.

Figure 5:
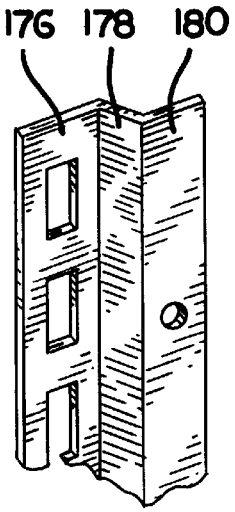
FIG. 5 is a variable tie guide bracket of the window pour mold.
Figure 6:
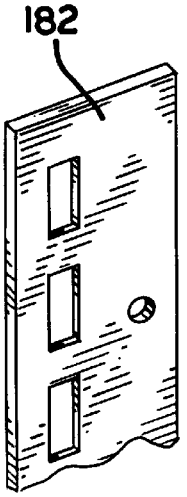
FIG. 6 is a variable tie guide bracket of the window pour mold.

FIGS. 5 and 6 show two variable tie guide bracket configurations. In FIG. 5, longitudinal wall 176 is parallel to, and spaced normally by wall 178 from, longitudinal wall 180. In FIG. 6, longitudinal wall 182 is planar.

Figure 7:
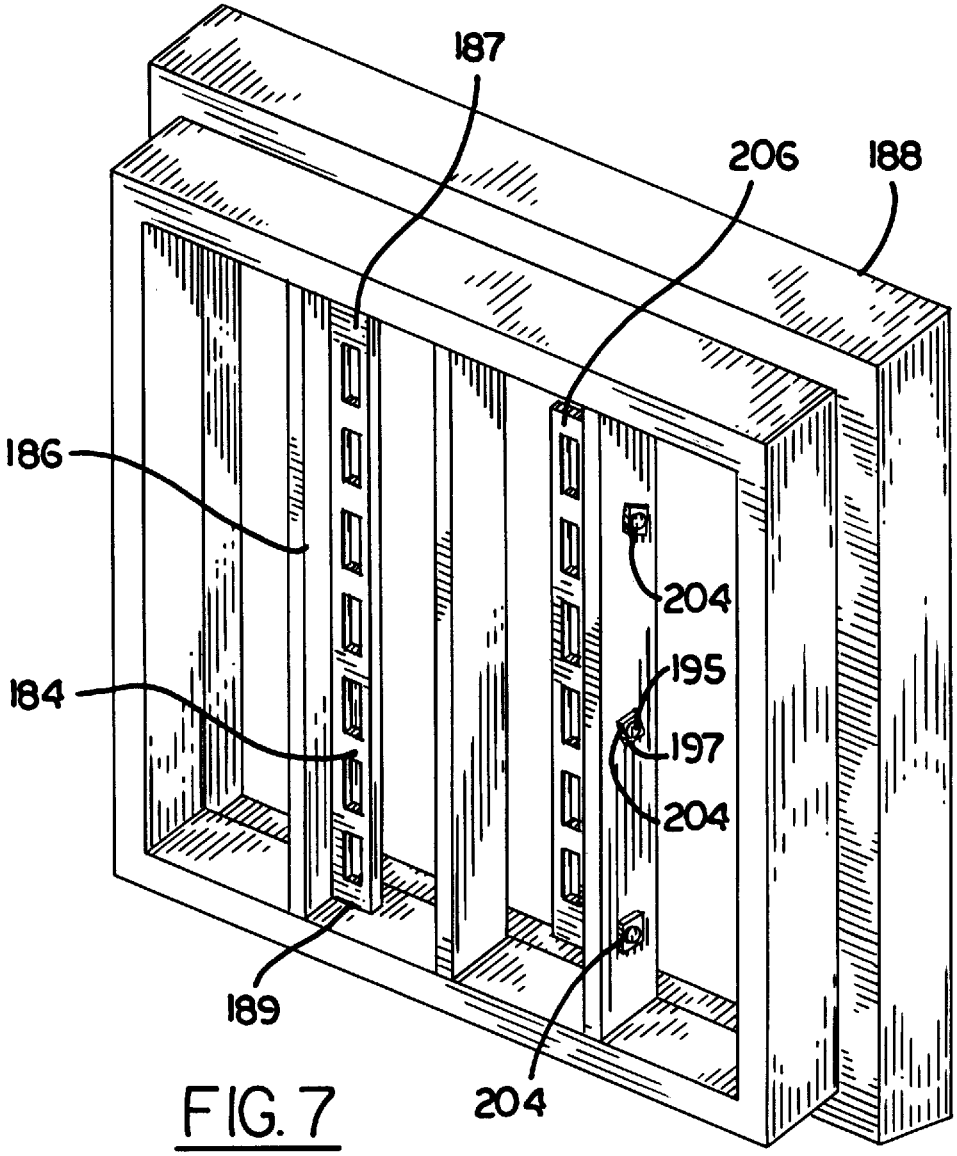
FIG. 7 is a perspective schematic view of a buck of the invention.

In FIG. 7, variable tie guide bracket 184 is mounted in buck 188 adjacent to reinforcement brace 186 and is welded at top 187 and bottom 189 to the buck. If a buck with a changeable variable tie guide bracket is desired, say to have the plurality of slots spaced more closely together vertically or moved horizontally, the variable tie guide bracket is attached with temporary fasteners such as bolt 195 and nut 197, at reusable attachment locations 204. Variable tie guide bracket 206 has slots matched vertically to variable tie guide bracket 184. Preferably the same mounting means is used for simultaneously used variable tie guide brackets on a buck or window frame.

Figure 8:
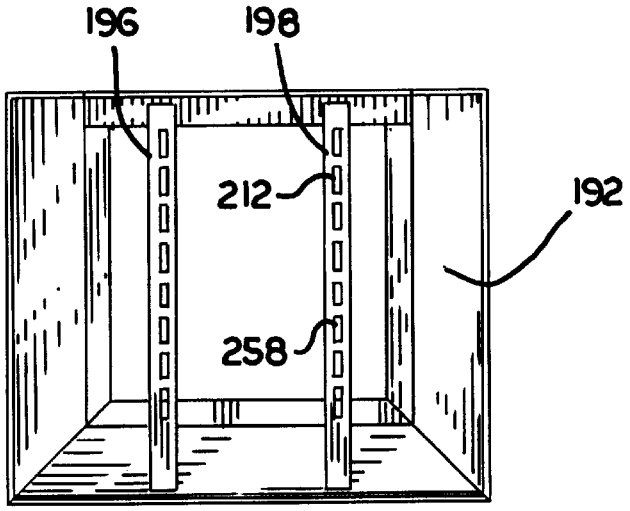
FIG. 8 is a front schematic view of a one piece pouring buck.
Figure 9:
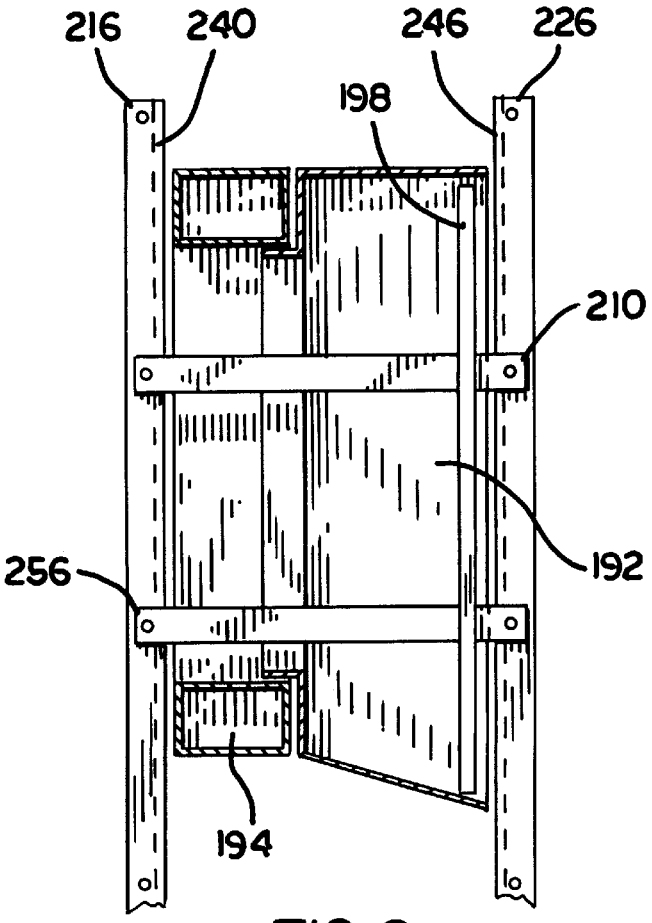
FIG. 9 is a left side schematic view taken at 9—9 of FIG. 10, of the one piece pouring buck of FIG. 8 with a window frame form mounted in a wall mold.
Figure 10:
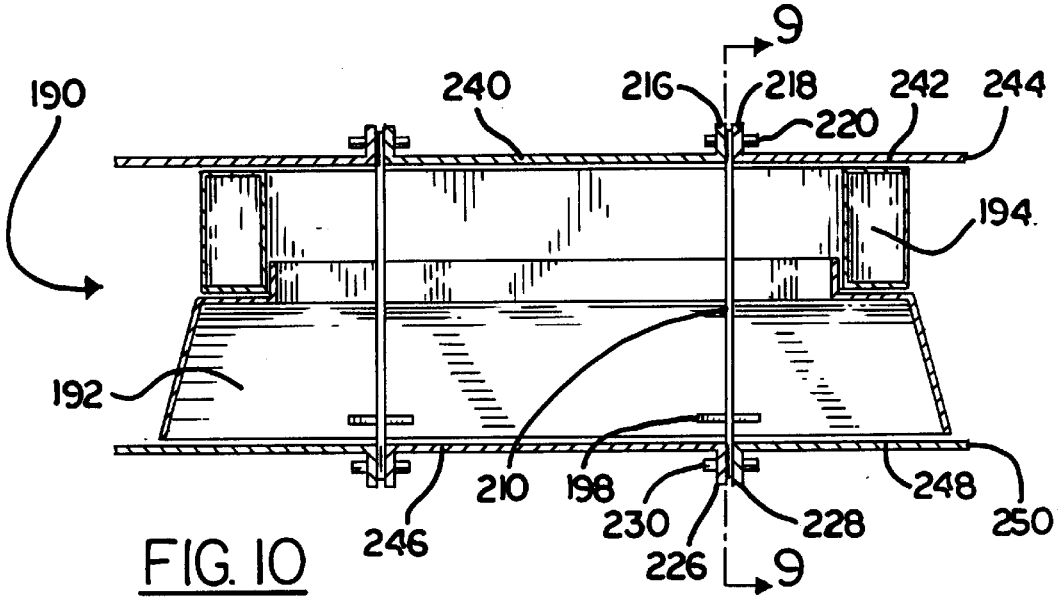
FIG. 10 is a top schematic view of the assembly of FIG. 9.

Referring to FIGS. 8, 9, and 10, window pour mold 190 includes buck 192 and window frame form 194. Mounted in buck 192 are variable tie guide brackets 196 and 198. Tie 210 extends through slot 212 of variable tie guide bracket 198. One end of the tie extends between panel connector flanges 216 and 218 of panels 240 and 242 respectively of concrete wall mold wall 244 where it is pinned therebetween by fastener pin 220. The other end of the tie extends between panel connector flanges 226 and 228 of panels 246 and 248 respectively of concrete wall mold wall 250, where it is pinned therein by pin 230. Similarly to tie 210, tie 256 is mounted through slot 258 of variable tie guide bracket 198.

Figure 11:
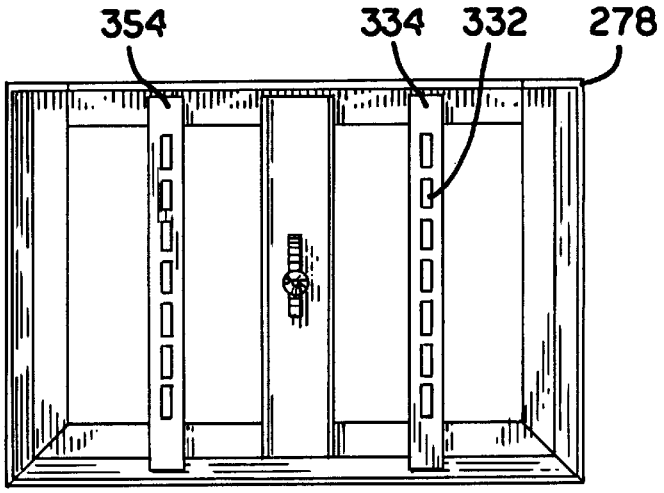
FIG. 11 is a front schematic view of a two-piece pouring buck.
Figure 12:
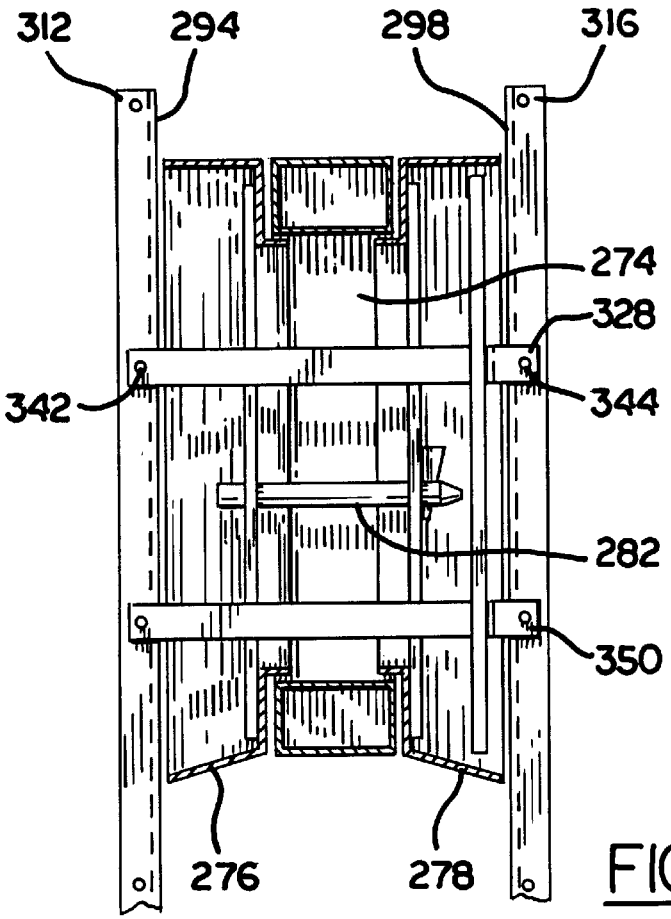
FIG. 12 is a left side schematic view taken at 12—12 in FIG. 13 of the two-piece pouring buck of FIG. 11 with a window frame form mounted within the buck, in a wall mold.
Figure 13:
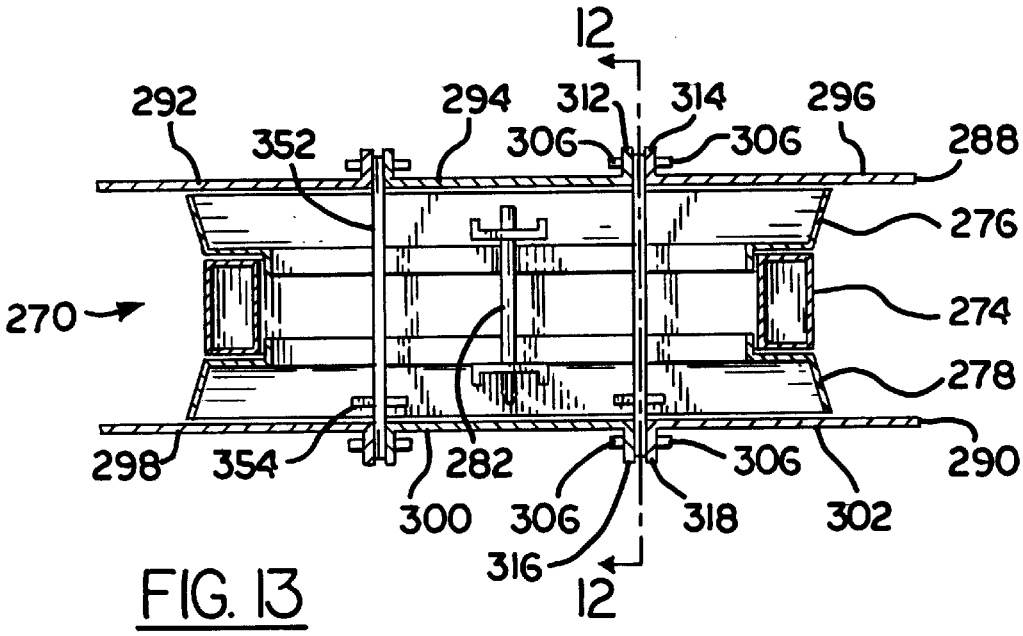
FIG. 13 is a top schematic view of the assembly of FIG. 12.

In FIGS. 11, 12, and 13, window pour mold 270 includes window frame form 274 mounted between two-piece buck sections 276 and 278, held together by removable assembly fastener 282.

Window pour mold 270 is mounted between concrete wall mold walls 288 and 290 which comprise panels 292, 294, 296, and 298, 300 and 302.

Panels 294 and 296 are fastened together by fasteners 306 which extend through panel connector flanges 312 and 314 on wall 288, and through panel connector flanges 316 and 318 on wall 290.

Tie 328 passes through slot 332 of variable tie guide bracket 334 and extends between panel connector flanges 312 and 314, and between panel connector flanges 316 and 318. Tie 328 is pinned between the flanges by fasteners 306 through holes 342 and 344.

Similarly to above, ties 350 and 352 pass through slots in variable tie guide brackets 334 and 354 respectively.

Figure 14:
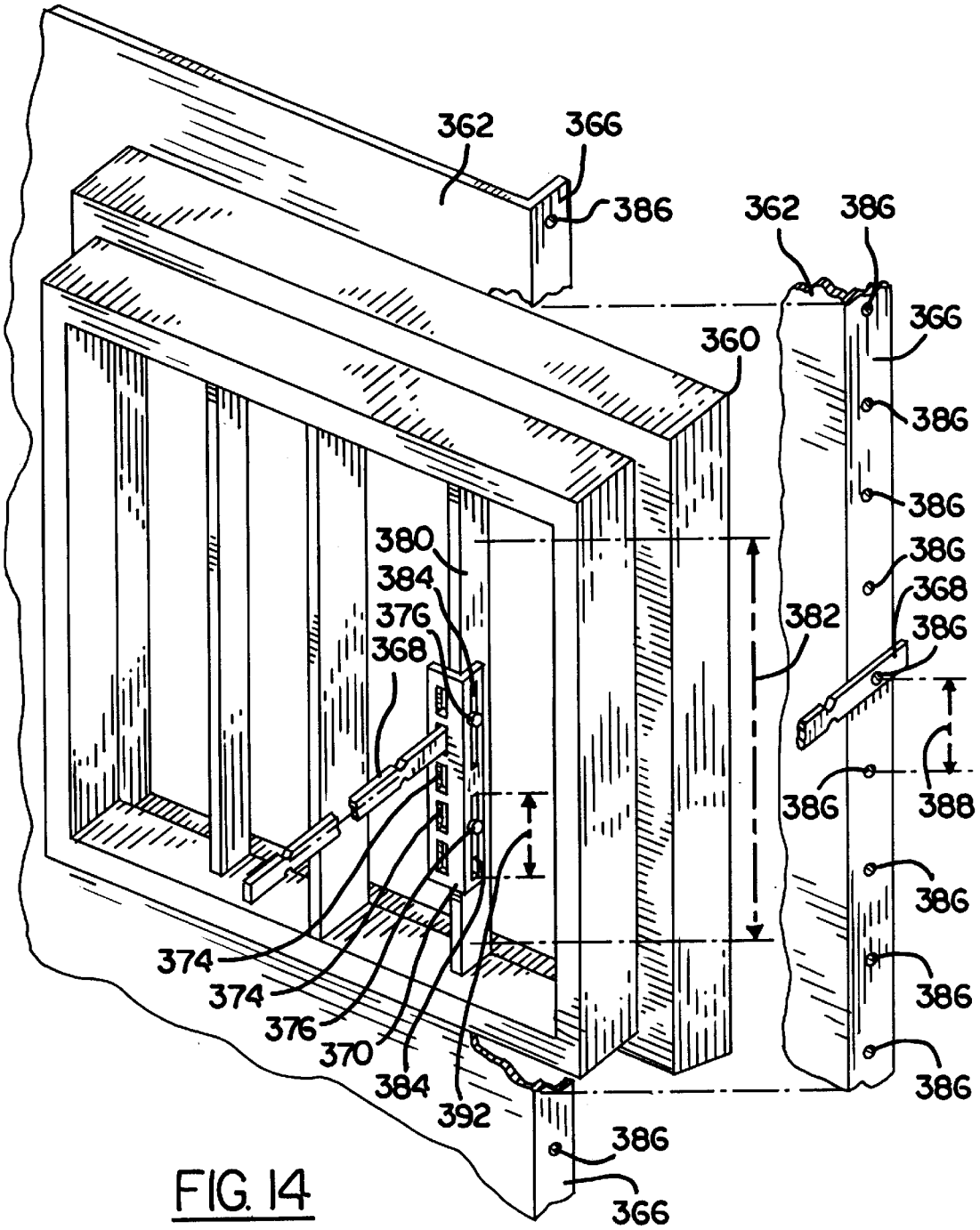
FIG. 14 is a perspective schematic view of a buck of the invention.

In FIG. 14, buck 360 is mounted on concrete wall mold wall 362 panel connector flange 366 by tie 368. Tie 368 extends through variable tie guide bracket 370 which supports buck 360. Variable tie guide bracket slots 374 support the buck at any of a plurality of heights for the same attachment of tie 368 to the concrete wall mold.

Bolts 376 clamp variable tie guide bracket 370 to reinforcement brace 380. By back screwing bolts 376 and releasing the clamping force, variable tie guide bracket 370 can be slid vertically 382 along tracks 384 and reclamped, for supporting the buck or a window pour mold at any height over a distance 388, which is the distance between two adjacent wall mold available attachment points 386 for the tie.

Variable tie guide bracket 370 having track 384 for moving it vertically can have just one slot 374 and track travel length of about 388 or longer, to move the variable tie guide bracket distance 388, to support the buck or a window pour mold at any height over a distance 388, or, the track travel length can be shorter than distance 388 and there be a plurality of slots 374 being closer together than distance 388, so that with the shorter movement of the variable tie guide bracket the buck, a window frame form, or window pour mold is supported at any height over a distance 388 because the movement of adjacent slots is made to overlap, and the tie can be passed through one of the plurality of slots.

Variable tie guide bracket 370 having track 384 can also be used with a single tie point of the tie to the wall mold to support the buck, a window frame form, or window pour mold at any height within predetermined limits of the track means having a length, 392.

Figure 15:
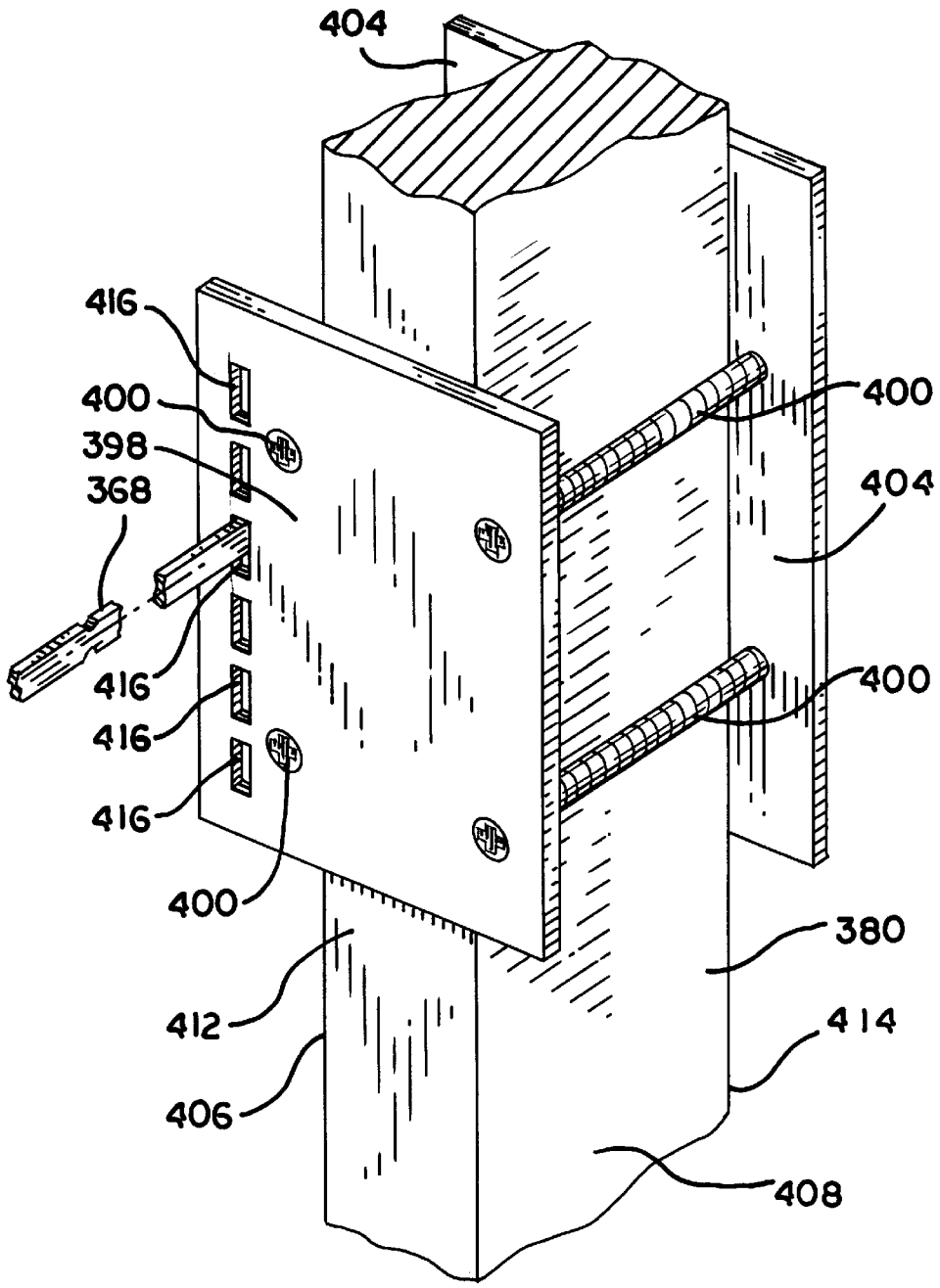
FIG. 15 is a perspective schematic view of a variable tie guide bracket and reinforcement brace assembly of another embodiment of the invention

In FIG. 15 variable tie guide bracket 398 is mounted on reinforcement brace 380 of a pouring buck. The pouring buck is similar to pouring buck 360, and is not shown in FIG. 15.

Variable tie guide bracket 398 is clamped on reinforcement brace 380 by threaded bolts 400 which can be rotated to draw variable tie guide bracket 398 toward back up plate 404. Bolts 400 straddle left side 406 and straddle right side 408 of brace 380 whereby they hold variable tie guide bracket 398 to the front 412 of the brace and hold back up plate 404 to the back 414 of the brace.

Tie 368 extends through variable tie guide bracket 398 which supports the buck. Variable tie guide bracket slots 416 support the buck at any of a plurality of heights for the same attachment of tie 368 to the concrete wall mold.

Bolts 400 clamp variable tie guide bracket 398 to reinforcement brace 380. By back screwing bolts 400 and releasing the clamping force, variable tie guide bracket 398 can be slid vertically along brace 380 and reclamped, for supporting the buck or a window pour mold at any height which includes a choice of slots 416.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A window pour mold positioning system comprising:

a wall mold comprising a first wall and a second wall spaced from said first wall for receiving cement material between said first wall and said second wall, a tie extending between said first wall and said second wall attached to said first wall and to said second wall, a window pour mold having a frame, and a length, a bracket having a length and a plurality of holes each adapted for receiving said tie through the bracket, said holes being spaced from one another lengthwise along a length of said bracket, said bracket being mounted on said frame, said tie extending through said bracket by one of said plurality of holes, between said first and second walls, supporting said window pour mold by said bracket.

2. The system of claim 1, in which said window pour mold comprises a plurality of existing means for fastening a window well, means for fastening arranged on said bracket configured for fastening said bracket to said existing means for fastening a window well on said window pour mold frame.

3. A window pour mold positioning system comprising:

a wall mold comprising a first wall having a height and a second wall having a height spaced from said first wall for receiving cement material between said first wall and said second wall, said first wall comprising a plurality of existing means for attaching a tie, spaced in a first predetermined pattern from one another heightwise on said first wall, a tie extending between said first wall and said second wall, attached to one of said first plurality of existing means for attaching a tie, and attached to said second wall, a window pour mold having a frame, and a length, a bracket having a length and a second plurality of holes each adapted for receiving the tie through the bracket and spaced in a second predetermined pattern from one another along the length of said bracket, said bracket being mounted on said frame, said tie extending through said bracket by one of said second plurality of holes, between said first and second walls, supporting said window pour mold by said bracket.

4. The system of claim 3, in which said window pour mold comprises a plurality of existing means arranged in a third predetermined pattern for fastening a window well, means for fastening arranged on said bracket configured for fastening said bracket to said existing means for fastening a window well on said window pour mold frame.

5. The system of claim 3 wherein said second predetermined pattern is different from said first predetermined pattern.

6. The system of claim 3, further comprising:

said bracket being mounted and configured on the frame for lengthwise with said second plurality of holes sliding movement on the frame.

* * * * *

UNITED STATES PATENT AND TRADEMARK OFFICE

CERTIFICATE OF CORRECTION

PATENT NO. : 5,843,323

DATED : 12/1/98

INVENTOR(S) : Renard

It is certified that error appears in the above-identified patent and that said Letters Patent is hereby corrected as shown below:

Column 4, line 18, after "schematic" insert --cross section--.

Column 4, line 27, after "schematic" insert --cross section--.

Signed and Sealed this

Ninth Day of March, 1999

*Attest:*

*Attesting Officer*

Q. TODD DICKINSON

*Acting Commissioner of Patents and Trademarks*